US005759076A

United States Patent [19]

Bateman et al.

[11] Patent Number: 5,759,076

[45] Date of Patent: Jun. 2, 1998

[54] LIGHTWEIGHT PERSONAL FLOTATION DEVICE

[75] Inventors: Bruce Randolph Bateman; Joshua R. Uth, both of Cincinnati, Ohio

[73] Assignee: Bruce Randolph Bateman, Cincinnati, Ohio

[21] Appl. No.: 840,054

[22] Filed: Apr. 24, 1997

[51] Int. Cl.[6] ..... B63C 9/08

[52] U.S. Cl. ..... 441/115; 441/117

[58] Field of Search ..... 441/80, 88, 90, 441/96, 99, 102, 106–108, 111–118, 119

[56] References Cited

U.S. PATENT DOCUMENTS

| | | | |
|---|---|---|---|
| Re. 31,305 | 7/1983 | Moran | 441/123 |
| 635,439 | 10/1899 | Kunert . | |
| 1,623,993 | 4/1927 | Anderson | 441/117 |
| 1,856,632 | 5/1932 | Haines . | |
| 2,703,891 | 3/1955 | Mayer . | |
| 2,748,047 | 5/1956 | Kuss . | |
| 2,784,426 | 3/1957 | Boyle et al. . | |
| 2,895,147 | 7/1959 | Desjarlais et al. . | |
| 3,103,022 | 9/1963 | Harding et al. . | |
| 3,104,403 | 9/1963 | Lortz . | |
| 3,754,731 | 8/1973 | Mackal et al. . | |
| 3,809,288 | 5/1974 | Mackal | 222/5 |
| 4,060,867 | 12/1977 | Miller . | |
| 4,150,464 | 4/1979 | Tracy . | |
| 4,171,555 | 10/1979 | Bakker et al. | 24/200 |
| 4,276,670 | 7/1981 | Marchello et al. . | |
| 4,348,449 | 9/1982 | Seufert | 428/167 |
| 4,379,705 | 4/1983 | Saotome | 441/94 |
| 4,496,328 | 1/1985 | Asher et al. | 441/55 |
| 4,523,914 | 6/1985 | Faulconer et al. | 441/108 |
| 4,622,018 | 11/1986 | Blanc | 441/123 |
| 4,623,316 | 11/1986 | Ratliff | 441/106 |
| 4,887,987 | 12/1989 | Kato | 441/96 |
| 4,889,511 | 12/1989 | Herman | 441/88 |
| 5,030,153 | 7/1991 | Bailey | 441/115 |
| 5,095,957 | 3/1992 | Herman | 441/88 |
| 5,338,239 | 8/1994 | Cleaveland | 441/106 |

OTHER PUBLICATIONS

Oceanic USA, *Oceanic® Bouyancy Compensators*, 3 page Brochure.

*Primary Examiner*—Jesus D. Sotelo

*Attorney, Agent, or Firm*—Wood, Herron & Evans, L.L.P.

[57] ABSTRACT

A one-piece lightweight personal flotation device which is aerodynamic and form-fitting for a male or female wearer includes an inflatable bladder having front and rear panels, the front panel having generally concave longitudinal side edges to create an hourglass shape suitable for a conforming and comfortable fit by a male or female wearer, and the rear panel defined by two sections separated by a vertical seam. The bladder is held to the torso of the wearer by lightweight elastic fabric side panels, to enhance the torso-conforming fit, particularly at the arm-holes and around the waist, so that the device fits the wearer similar to a relatively tight vest. Bladder inflation components are located at accessible positions adjacent the outer surface of the bladder, and held within covers or pockets made of stretchable material, thereby to minimize aerodynamic drag, optimize comfort and to reduce the possibility of inadvertent filling of the bladder.

12 Claims, 4 Drawing Sheets

LIGHTWEIGHT PERSONAL FLOTATION DEVICE

FIELD OF THE INVENTION

This invention relates generally to a flotation device, and more particularly, to a lightweight personal flotation device which is aerodynamic and form-fitting for either a male or female.

BACKGROUND OF THE INVENTION

Several inflatable emergency flotation devices are known in the art. A disadvantage of many of these prior art inflatable emergency flotation devices is their bulkiness and/or heavy weight in both their inflated and uninflated state, making them cumbersome and/or uncomfortable to wear.

Those people who typically wear or desire to wear such flotation devices generally include recreational users like swimmers, boaters, and water skiers. However, these users do not want to be hindered by a bulky flotation device that interferes with their water activities. Athletes, such as long distance swimmers and triathlon competitors, may also desire to wear a flotation device during training and competition to prevent accidental drownings that have occurred during swim races in the past. During competitive swimming races especially, racers violently kick their legs and move their arms as they quickly swim through the water, often resulting in nearby swimmers receiving physical blows from such movements. Such blows have been known to injure nearby swimmers to the extent that the injured swimmers can no longer swim or stay afloat independently, and thus, accidentally drown.

Occurrence of a heart attack is another potential water tragedy for athletes engaged in strenuous water exercising, which almost always results in the person being unable to swim or independently stay afloat. A flotation device is therefore necessary to keep the person afloat when such a life-threatening event occurs.

While athletes and recreational users may desire to wear personal flotation devices, acting on this desire is generally not practical considering the heavy, bulky and cumbersome devices of the prior art. Recreational users and athletes, particularly those competing in races, have not worn such flotation safety devices predominantly because they are heavy and non-aerodynamic, thereby interfering with the water activity or hindering the athlete's race performance. None of the prior art flotation safety devices are suitable for such events as they are not lightweight or aerodynamic.

Another disadvantage of the personal flotation devices found in the prior art, particularly for females, is that the devices are generally not designed for a snug and aerodynamic fit of the female upper body. That is, most of the prior art personal flotation devices are suspender-like which may be suitable for a male, but not a breasted female, because such suspender-like prior art flotation devices are positioned over the breasted portions of the torso resulting in an improperly-fitting and non-aerodynamic personal flotation device for women. Such improperly-fitting, non-aerodynamic prior art devices are highly undesirable for females, particularly athletes and recreational users.

U.S. Pat. No. 4,060,867 discloses an example of a typical prior art heavy, bulky and cumbersome personal flotation device. A life vest is provided that is double-tubed with the inside marginal edges of the tubes fastened to each other. While the device provides sufficient buoyancy to support a person, such device is not well-suited for the active recreational user or athlete. This device is not aerodynamic, and thus would hinder movement through the water.

U.S. Pat. No. 5,338,239 discloses a personal flotation device that consists of a meshed vest, a folded float, a stretch material compartment for the float and an actuator. The personal flotation device is fairly lightweight as it apparently weighs only about eight ounces. Although the device is somewhat lightweight, it is still fairly bulky and non-aerodynamic, and ill-suited for recreational users and athletes as it consists of nonconforming full front and rear panels sewn together along the edges thereof, thereby resembling a loose-fitting, sleeveless shirt. This design is not suitable or acceptable for a racer where aerodynamic design is critical.

Other bulky and non-aerodynamic flotation devices include those disclosed in U.S. Pat. Nos. 4,496,328, 3,103,022, 2,784,426 and Re. U.S. Pat. No. 31,305. While these devices provide the necessary buoyancy to a user, they are not suitable for today's recreational user and athlete who require more streamlined devices.

U.S. Pat. No. 4,887,987 discloses an inflatable emergency flotation device designed to be worn around the neck of the wearer and strapped to the front of the wearer's body. While this device is lightweight and non-cumbersome, it is not well suited for female wearers. That is, the straps which run down the front of the wearer's body are suspender-like preventing a snug and aerodynamic fit for a female. Also, the device is designed such that the inflation device must be positioned on the strap that runs down the front of the wearer's body. For a swimmer whose body front is typically submerged in water throughout a race, this is unsuitable as the inflation device would project downward into the water creating water resistance and thereby result in a non-aerodynamic design, or possibly undesired contact with another competitor in a competitive swimming race.

Non-athletes and non-recreational users may also desire lightweight, non-bulky personal flotation devices. For example, businesses involved in providing services to customers in, on, or above water, including passenger carriers such as airlines and cruise ships, typically desire lightweight, non-bulky and easy-to-store personal flotation devices that can quickly be placed on and inflated by an individual in the event that a water emergency arises.

BRIEF SUMMARY OF THE INVENTION

It is an object of this invention to improve upon the lightweight and aerodynamic properties of conventional personal flotation devices.

It is another object of the invention to minimize the cumbersome aspects of a personal flotation device, in a manner which is suitable in design for either a male or a female.

It is still another object of the invention to increase the versatility of personal flotation devices, to make their use more common, thereby reducing the occurrence of drowning.

The present invention achieves the above-stated objectives by utilizing, for a personal flotation device, an inflatable conformable bladder which extends around a person's torso, the bladder defined by connected front and rear panels with a head receiving opening located therebetween, the front and rear panels further interconnected along the sides of the wearer by stretchable side panels which tightly conform the device to the torso of the wearer.

This entire structure is relatively lightweight, and the stretchable side panels provide aerodynamic advantages because of the manner in which they promote conformance of the device to the body of the wearer, almost like a fairly tight vest, with unhindered arm access.

Each of front and rear panels of the bladder has concave side edges defining a generally hourglass shape. Because of this shape, particularly for the front panel, the device is well-suited for either a male or female wearer.

Preferably, the flotation device of this invention has an encircling waist portion, with elastic enclosed therein for improved aerodynamic properties at the waist of the wearer. The waist portion interconnects the bottom edges of the front and rear panels to the side panels, around the waist of the wearer. The waist portion may be advantageously made of the same material, and integral with, the side panels.

The flotation device may further include a neck panel for encircling the head opening to reside between the neck of the wearer and the uppermost edge portions of the front and back panels of the bladder. The neck panel, the side panels, and the waist portion each have elastic for surrounding the neck, the arms, and the waist portion of the wearer, respectively, to promote a relatively tight torso-conforming and aerodynamically snug fit, to minimize water intrusion.

The flotation device includes an inflation assembly for inflating the bladder, including a manually or automatically operated inflation cartridge which contains compressed gas to fill the bladder, and additionally or alternatively, a blow tube for the wearer to inflate the bladder by blowing. Advantageously, the inflation cartridge is located in a pocket secured to the bottom of the rear panel, the pocket being defined by a piece of material sewn to the rear panel along its entire periphery except for a relatively short length along a bottom edge of the piece of material, the unstitched portion defining a small opening in the pocket for access to the compressed gas cartridge. A stretchable actuation cord extends from the pocket through a conduit along one of the side panels, with a handle at the end thereof being retained in an external panel, or cover. The blow tube is advantageously located along an upper end of the bladder front panel, to facilitate blowing by the wearer, and is also preferably located within a panel or cover.

Preferably, the bladder is formed first out of two separate pieces of bladder material. The pieces are secured together along their edges to define the front and back panels with the head opening located centrally, with both the front and the back panels being generally hourglass-shaped. To avoid "bunching" of the device when inflated, and so as to improve comfort and aerodynamics, to minimize personal discomfort and to promote unhindered arm movement, the rear panel is actually divided vertically by a vertical seam extending from the head opening to the bottom. This seam separates the rear portion of the bladder into separate left and right sections, although the entire bladder comprises only a single fluid containment unit, with all portions thereof being in fluid communication. The overlaid front and back bladder pieces are secured together along their corresponding edges so as to be watertight. The pocket on the rear panel is formed by securing an additional piece to the bottom of the outermost piece of the back panel. The uppermost edge of the additional piece must be secured so as to be watertight.

The side panels and waist portion are preferably formed as two-identical, mirror-image pieces. Each piece has the two upper free ends which are secured together to define an armhole, and the lower free ends of the two side panel pieces are secured to the opposing free ends of the other side panel piece to define the torso-encircling waist portion to which the bladder is then secured. The neck-encircling portion is then secured to the inner edge of the head-opening defined by the bladder.

The inflation assembly is then located in the rear pocket, with the hand operated cord extending out from the pocket to one side panel and the blow tube located at an upper part of the bladder, for relatively easy use and access. Both the handle at the end of the hand cord and the blow tube are preferably held within securable, but openable, covers, thereby to enhance the aerodynamics of the device by reducing drag and minimizing the possibility of inadvertent inflation of the bladder.

These and other features of the invention will be more readily apparent in view of the accompanying drawings and the detailed description.

DETAILED DESCRIPTION OF THE DRAWINGS

Figure 1:
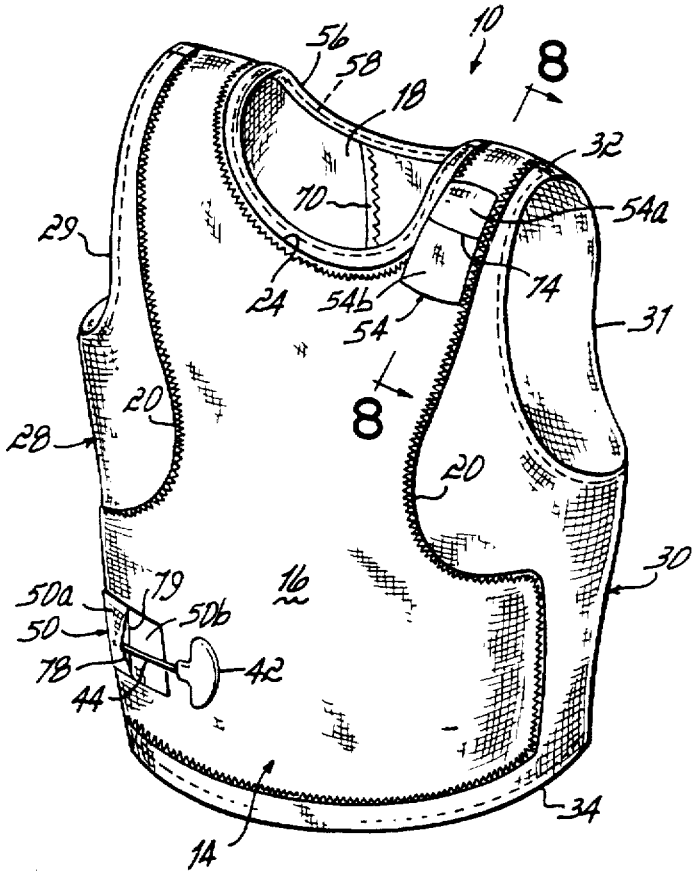
FIG. 1 is a front perspective view of a personal flotation device according to a first preferred embodiment of the present invention.
Figure 2:
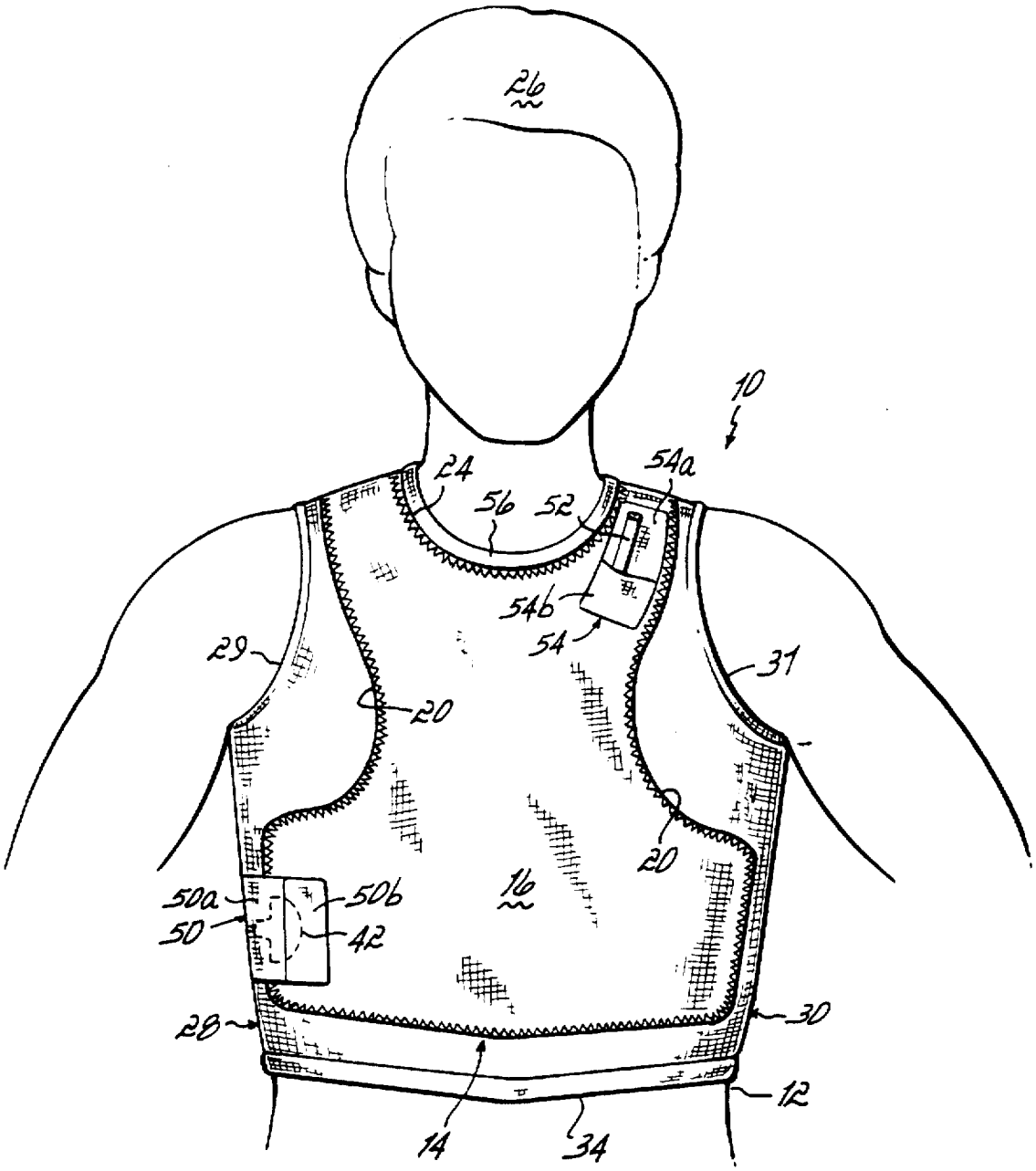
FIG. 2 is a front view of the personal flotation device of FIG. 1, in use.

As shown in FIGS. 1 and 2, a personal flotation device 10 according to a preferred embodiment of the invention is aerodynamic and non-bulky. The personal flotation device 10 is designed to be worn around and to conform to the torso 12 of a male or female wearer, as one would wear a vest, but with a relatively snug, or tight, fit.

The personal flotation device 10 includes an inflatable bladder 14 which when inflated, is responsible for keeping the wearer afloat. Bladder 14 has a front panel 16 and rear panel 18 to form a singular fluid-containing unit. The front panel 16 is positioned on a front side of the torso 12 while the rear panel 18 is positioned on a backside, or rear of the torso 12. The front panel 16 has longitudinal concave side edges 20 to define a generally hourglass shape. The rear panel 18, likewise, has longitudinal concave side edges 22 which are slightly different in shape but also generally define an hourglass shape. This hourglass shape, particularly of front panel 16, makes the personal flotation device 10 of this invention well-suited for either a male or a female wearer. The front panel 16 of bladder 14 fits between the breasted portions (not shown) of the torso 12 to thereby allow a snug fit. Bladder 14 has a generally circular head opening 24 for extendably receiving a head 26 of the wearer therethrough.

The personal flotation device 10 includes a first side panel 28 and a second side panel 30, for the left and the right sides of the torso 12, respectively. The first side panel 28 is secured to one of the longitudinal concave side edges 20 of front panel 16 and one of the longitudinal concave side edges 22 of rear panel 18. The second side panel 30 is likewise secured to the remaining longitudinal concave side edge 20 of front panel 16 and the remaining longitudinal concave side edge 22 of rear panel 18. Thus, the personal flotation device completely encircles torso 12.

Both the first and second side panels 28, 30 have openings 29, 31, respectively, for receiving first and second arms of a person wearing the device 10. Openings 29, 31 are generally circular in shape, like head opening 24. Preferably, the openings 29 and 31 include elastic adjacent the edges for tightly surrounding the arms of the wearer. Also, the bottom encircling edge of the two joined side panels 28 and 30, which define a waist encircling portion 34 of the device 10, includes elastic for a snug fit for the wearer.

Figure 3:
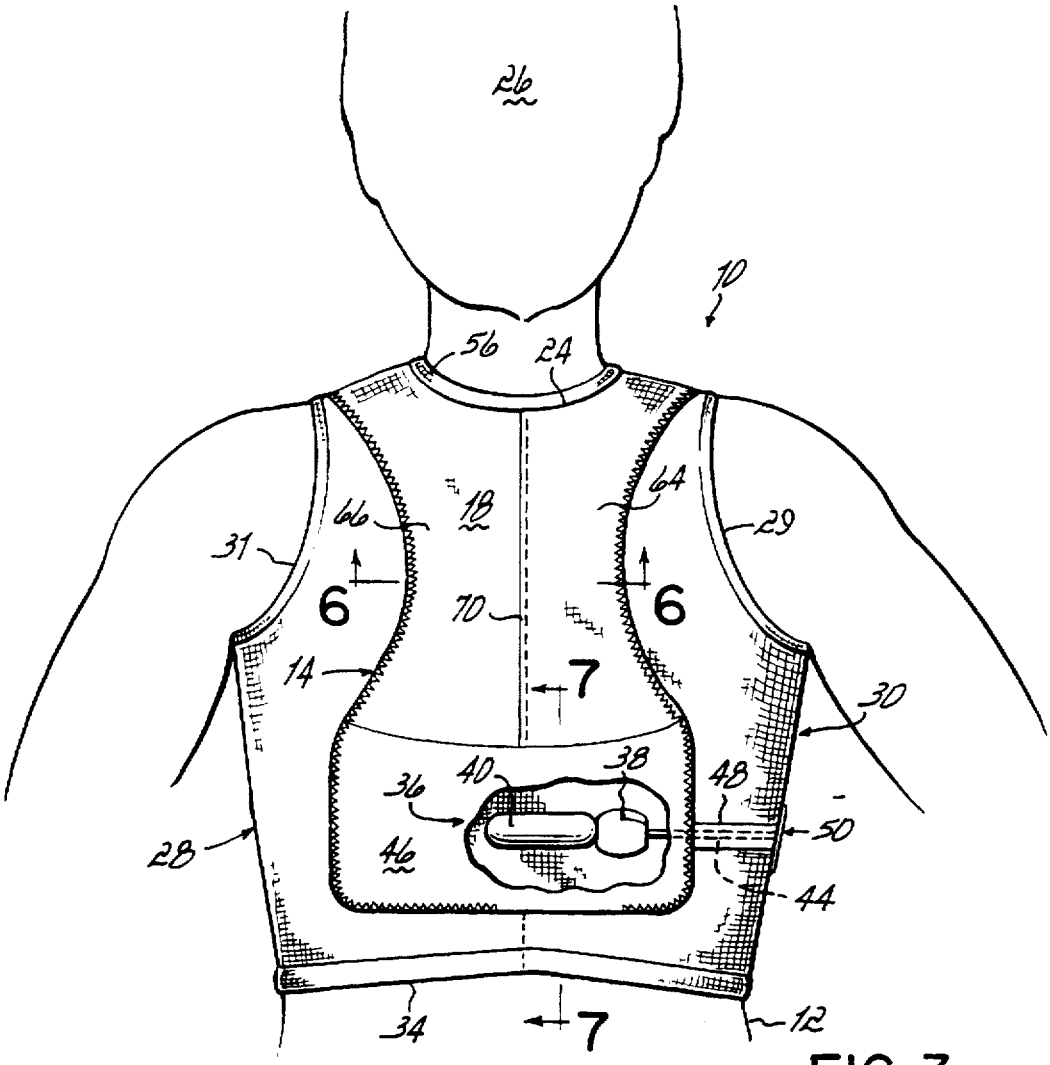
FIG. 3 is a rear view of the personal flotation device of FIG. 1, in use.

The personal flotation device 10 includes an inflation assembly 36 for inflating bladder 14, as can be more clearly seen in FIG. 3. Preferably, the inflation assembly 36 has an inflator 38 with a threaded sleeve (not shown) and an inflation cartridge 40 having a threaded neck (not shown) for cooperative engagement with the sleeve of the inflator 38. Inflation cartridge 40 contains a compressed inert gas such as carbon dioxide and is commercially available from Leland Ltd of Bedminster, N.J. Typically, inflation cartridge 40 has a soft seal (not shown) which is easily pierced when it is desired to inflate the bladder 14, so that upon piercing the seal, the carbon dioxide gas releases from the inflation cartridge 40 and passes through the inflator 38 which is in fluid communication with bladder 14, thereby to fill the bladder 14. When it is desired to inflate bladder 14, a piercing member (not shown) may be activated by pulling on a handle 42 attached to a stretchable cord 44 which, in turn, is connected to a piercing member in the inflator 38 responsible for piercing the soft seal of inflation cartridge 40. Thus, pulling on handle 42 and cord 44 actuates the piercing member to pierce the seal of inflation cartridge 40, thereby releasing carbon dioxide gas into inflator 38 and subsequently into bladder 14 to inflate the bladder 14 (FIG. 6A). The cord 44 and the handle 42 are positioned on the personal flotation device 10 such that a user has easy access to handle 42 and cord 44 to inflate bladder 14 when desired, while the rest of the inflation assembly 36 is also conveniently located for maintenance, but is unobtrusive during use.

Figure 7:
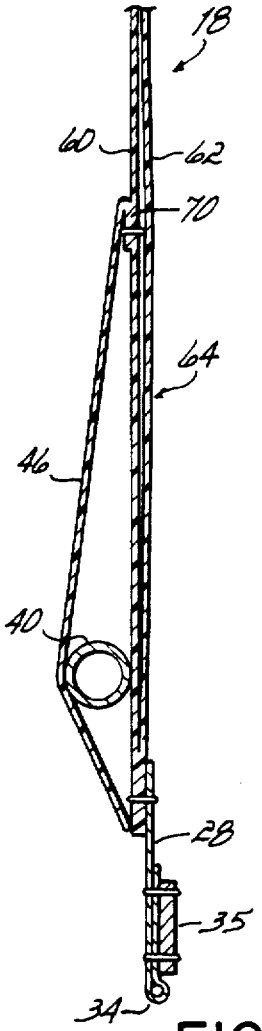
FIG. 7 is a cross-sectional view taken on lines 7—7 of FIG. 3.

More specifically, the inflation cartridge 40 and inflator 38 are located within a downwardly opening pocket 46 which is secured to rear panel 18 as shown in FIG. 7. Cord 44 resides within an enclosed channel 48 which extends from a side edge of pocket 46 to a side pocket, or cover 50, located on one of the side panels, 28 or 30, for easy manual access by the user. The channel 48 may be formed by an elongated piece of the same fabric as the side panels 28, 30, and sewn to the side panel. Location of inflation cartridge 40 and inflator 38 on rear panel 18 of bladder 14 has distinct advantages for swimmers and racers, by minimizing drag and enhancing the aerodynamic performance of the personal flotation device 10. More particularly, because the inflator 38 and inflation cartridge 40 are located on the backside of torso 12, which generally is not submerged in the water during a race, little or no water resistance results from the presence of inflator 38 and inflation cartridge 40. Furthermore, the pocket 46 containing the inflator 38 and inflation cartridge 40 further facilitates the aerodynamic design of personal flotation device 10 by creating a smooth surface over inflator 38 and inflation cartridge 40, over which water may readily pass if rear panel 18 of bladder 14 does become submerged in water.

Similarly, the cover 50 containing the handle 42 reduces water resistance that may otherwise be created if the handle 42 were simply free and exposed. Namely, the pocket 50, thereby creates a smooth surface over which water may readily flow. The pocket 50 also prevents inadvertent actuation. Likewise, the channel 48 containing cord 44 reduces water resistance in the same manner and retains the cord to prevent entanglement.

It is important that the cord 44 be stretchable so that as the side panel 28 expands, such as when putting the vest on or taking a deep breath, the inflation assembly 36 is not inadvertently activated by transfer of force from the side panel 28 to the cord 44. Advantageously, the cord 44 is sufficiently stretchable that the inflation assembly 36 is not inadvertently activated within a full range of expected user activity, as well as in the event that the handle 42 is accidentally snagged, but the cord 44 reaches an elastic limit after being pulled significantly. Thus, when it desired to inflate the device, the cord 44 is pulled to its elastic limit and then is further pulled to activate the inflation assembly 36.

With reference to FIG. 2, the personal flotation device 10 may alternatively, or additionally, have a blow tube 52 located on the front panel 16 of bladder 14, near the head opening 24 to facilitate easy access to the blow tube 52 by the user. The blow tube 52 extends into the interior of bladder 14, and is adapted to receive air or gas. The blow tube 52 includes a one-way valve, with an air release feature to enable deflation of the device 10 after use. Also, the blow tube 52 may be enclosed in a pocket or cover 54 on the front panel 16 of the bladder 14 near the head opening 24, to further enhance the aerodynamic nature of personal flotation device 10.

The personal flotation device 10 may also have a neck encircling panel 56 surrounding the head opening 24. The neck panel 56 and side panels 28, 30 are preferably made of a lightweight, stretchable, breathable material, such as a lycra-nylon stretch fabric blend. This material is highly conformable to various shapes of torsos. This material promotes a snug fit and furthers the objectives of a personal flotation device 10 which is lightweight and achieves advantageous aerodynamic performance. Additionally, a band of elastic 58 may be located around the head opening 24 in neck panel 56, similar to the elastic edge bands utilized around the edges of arm openings 29, 31 in the side panels 28, 30 and around the waist portion 34, thereby serving to minimize water intrusion to the wearer through respective openings 24, 39, 31 and around the waist.

Figure 6:
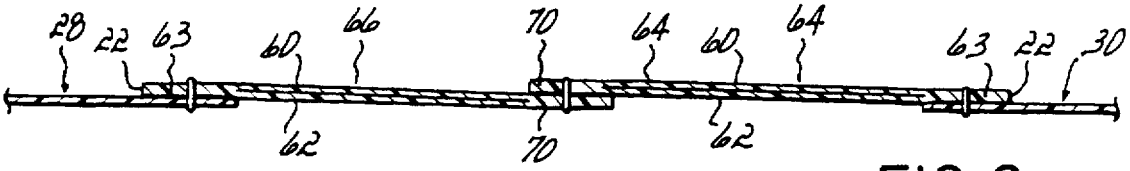
FIG. 6 is a cross-sectional view taken on lines 6—6 of FIG. 3.
Figure 6A:
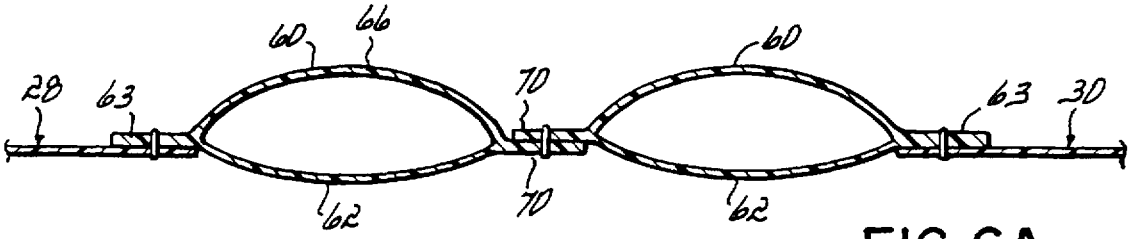
FIG. 6A is a view similar to FIG. 6 showing the bladder in an inflated position.
Figure 5:
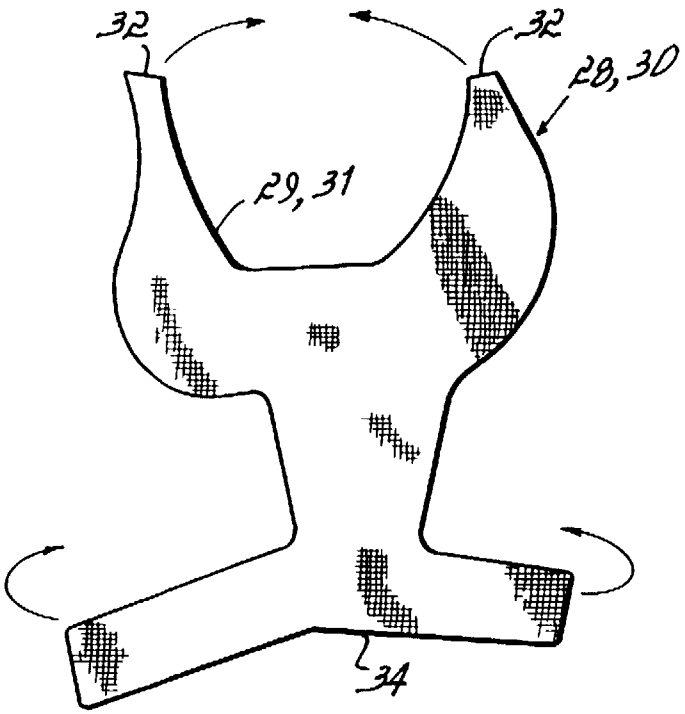
FIG. 5 is a develop view of one of the side panels of the personal flotation device of FIG. 1.
Figure 4:
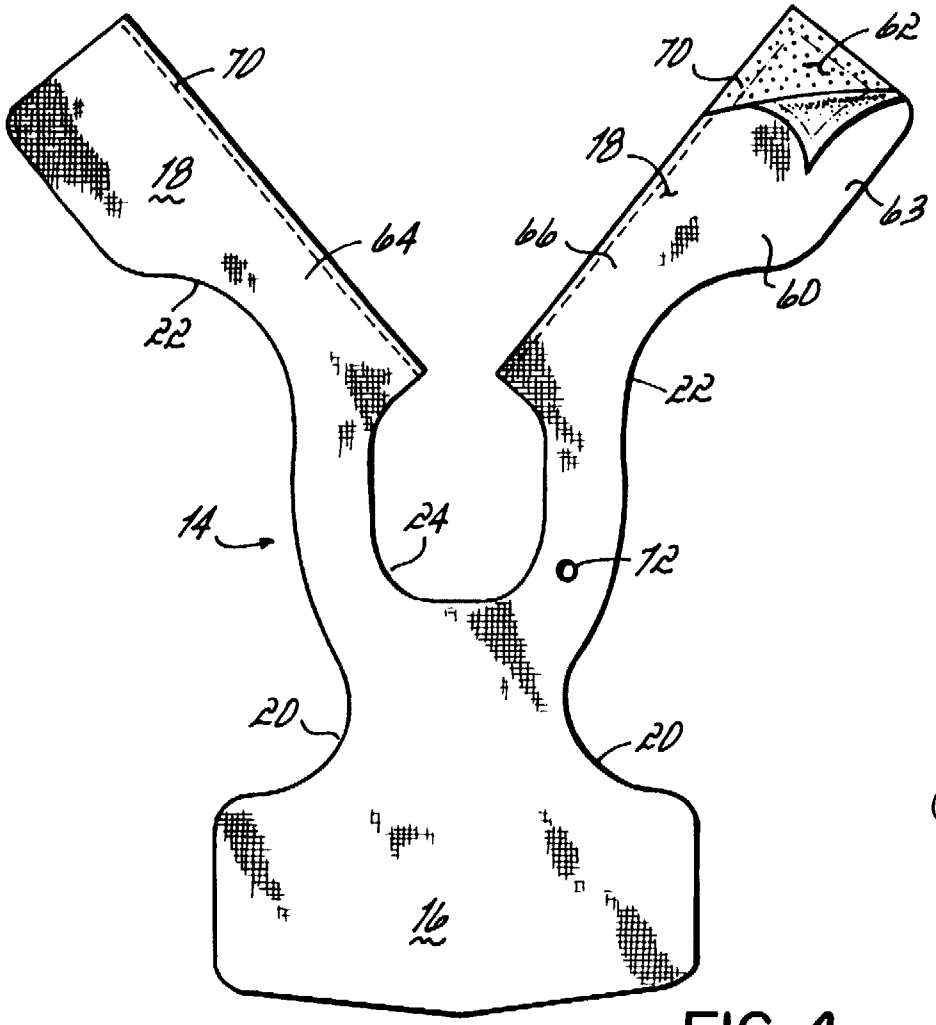
FIG. 4 is a develop view of the bladder of the personal flotation device of FIG. 1.

As shown in FIGS. 4 and 6, the bladder 14 itself is made of two edge-secured pieces of a lightweight stretchable material. Applicant has used a nylon lycra-coated polyurethane material available from Mann Industries of Framingham, Mass. The two pieces of the bladder 14, a double layer 60, 62 of such stretchable material are preferably secured by heat sealing, RF welding, or ultrasonic welding, along all peripheral edges thereof to form a fluid tight bladder 14.

To make the bladder 14, the two bladder pieces 60, 62 are cut out to form the shapes shown in FIG. 4, and then overlaid. While the overlaid portions of layers 60, 62 which form the front panel 16 are defined by single sections of the pieces, the portions of layers 60, 62 which form the rear panel 18 are not, but instead include two separate longitudinally-cut sections 64, 66. In forming bladder 14, both layers 60, 62 are sealed along their perimeter. Additionally, the two longitudinally cut sections 64, 66 of the rear panel 18 are sealed vertically from top to bottom, to form a longitudinal, preferably vertical, seam 70 (FIGS. 6 and 6A) which extends along the rear panel 18 from the head opening 24 to the bottom edge. All portions of the bladder 14 are in fluid communication, as one fluid containment unit, but the seam 70 isolates the left and right sections of the rear panel 18. The seam 70 helps to minimize "bunching" of the device 10, and to improve conformity to the torso 12, thereby to enhance the overall aerodynamics. Also, when the device 10 is inflated, the seam 70 in combination with the particular shape of the front panel 16 and the rear panel 18, helps to buoy the wearer in a manner such that the head is slightly tilted toward an upright or rearward direction.

Sealing along all edges may be accomplished by one or any combination of various methods known in the art, for example, heat sealing, RF welding, ultrasonic welding, adhesive bonding, and/or seam tape. Additionally, the peripheral edges of the two pieces 60, 62 which form the bladder 14 may be sewn together or to other components. The resulting bladder 14 must be fluid-tight such that the fluid, i.e., air or gas, used to inflate bladder 14 cannot escape therefrom and water cannot enter therein.

After bladder 14 is formed, the side body panels 28, 30, are sewn to opposite sides of, and to the bottoms of the front 16 and rear 18 panels of, the bladder 14. Each of the pieces of material used to form a side panel 28 or 30 has an arm opening 29 or 31 which is formed by sewing together opposing upper ends 32 thereof. The waist portion 34 is defined by the waist encircling portion of the secured panels 28, 30, at the bottommost part of the device 10. Additionally, the neck panel 56 may be sewn around the inside of the head opening 24. Preferably, the neck panel 56 and the side panels 28, 30 have elastic (not shown) sewn around respective head opening 24 and arm openings 29, 31. Similarly, elastic 35 is provided around the waist portion 34 encircling the waist of the torso 12, and defined by the panels 28, 30. The resulting personal flotation device 10 completely surrounds the torso 12 of a person with the arms and head 26 extending through the respective openings 24, 29 and 31, providing a snug but flexible fit.

Figure 8:
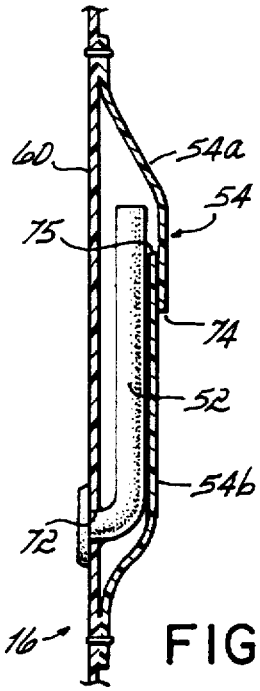
FIG. 8 is a cross-sectional view taken on lines 8—8 of FIG. 1.

The front panel 16 may have an opening 72 (FIG. 4) located near head opening 24 for receiving the blow tube 52. Blow tube 52 extends in fluid communication with the interior of bladder 14, yet is easily accessible by the user in case of emergency, or failure of the cartridge 40 to fill the bladder 14, such that the user can easily blow into the blow tube 52 through opening 72 to inflate the bladder 14. The bladder opening 72 is tightly sealed around blow tube 52 such that air or gas used to inflate the bladder 14 cannot escape therefrom. As best shown in FIG. 8, blow tube 52 and opening 72 are preferably covered by the cover 54 formed by two fabric flaps **54*a*, 54*b* which overlap slightly in the vicinity of the blow tube 52. Each of the flaps 54*a*, 54*b* is stitched to the bladder 14 along its periphery except in the region where the flaps 54*a*, 54*b* overlap. The flaps 54*a*, 54*b* thus may be parted at their unstitched edges 74, 75 to define an opening for access to the blow tube 52, but in their normal slightly overlapping positions serve to cover the blow tube 52 and opening 72 in a streamlined and aerodynamic fashion. The blow tube 52 includes a one-way valve with an air release feature to allow deflation of the bladder 14**.

With reference to FIGS. 1–3, a piece of material is sewn to rear panel 16 to form the rear pocket 46 for containing the inflator 38 and inflation cartridge 40. The channel 48 extends from the pocket 46 along one of the side panels with the stretchable cord 44 residing therein. A handle 42 located at the end of cord 44, for activating inflation cartridge 40, is preferably removably held within two flaps **50*a*, 50*b* sewn to the side panel in a fashion similar to the flaps 54*a*, 54*b* which cover the blow tube 52, to form a cover 50 for containing the handle 42 therein. Thus, the flaps 50*a*, 50*b* have edges 78, 79 which slightly overlap in the vicinity of the handle 42, and are stitched to the side panel along their peripheries except in the region of the overlap, thereby covering the handle 42 in an aerodynamic fashion and permitting access to the handle 42 via an opening defined by the unstitched edges 78, 79 of the flaps 50*a*, 50*b*. The flaps 50*a*, 50*b*, 54*a*, and 54*b* and the rear pocket 46 are preferably made of a lycra-coated neoprene material. By enclosing the inflation actuation components (blow tube 52, handle 42, cord 44, inflator 38 and cartridge 40), the device 10 minimizes aerodynamic drag, and also prevents inadvertent filling of the bladder 14. It will be appreciated that along the edges of the pocket 46 and the flaps 50*a*, 50*b*, 54*a*, and 54*b* which are secured to the bladder 14, if securing is accomplished by stitching it is important to seal the stitch lines, such as by the use of seam tape, because sewing alone causes penetration to the interior of the bladder 14, and it is necessary that any such penetration remain fluid-tight, or at least, if the edges are to be sewn, care must be taken to sew in a manner which does not adversely effect the fluid containing capability of the bladder 14. It will also be appreciated that the covers 50 and 54 for the handle 42 and the blow tube 52**, respectively, each may alternatively be formed of a single piece of material secured to the device and having a free end which may be folded over to cover the handle or blow tube and releasably held in the folded-over position, such as with hook-and-loop fasteners.

While the present application includes a detailed description of the preferred embodiment of the invention, the invention in its broader aspects is not limited to the specific details, representative apparatus and method, and illustrative example shown and described. Additional advantages and modifications will be readily apparent to those skilled in the art.

We claim:

1. A flotation device for buoyantly supporting a human wearer comprising:

an inflatable and stretchable bladder including front and rear panels for covering the front and rear portions of the torso of the wearer, respectively, the bladder defining a head opening, the front panel having side edges defining a generally hourglass shape;

opposing stretchable side panels secured to the front and rear panels to snugly hold the bladder to the front and rear portions of the torso of the wearer, each of the side panels having an arm opening; and, an inflation device in fluid communication with the bladder for selective inflating thereof, the inflation device residing at least partially within an enclosed, but openable, cover secured to the bladder.

2. The flotation device of claim 1 wherein the inflation device comprises a blow tube in fluid communication with the bladder adjacent an upper end of the front panel, for inflating said bladder, and further comprising:

a cover secured to the bladder adjacent an upper end of the front panel of the bladder, for selectively covering the blow tube, the cover being openable to selectively expose the blow tube for filling the bladder by blowing.

3. The flotation device of claim 1 wherein the inflation device includes an inflation assembly and further comprising:

a pocket secured adjacent a bottom of the rear panel of the bladder, the inflation assembly located within the pocket.

4. The flotation device of claim 3 wherein the pocket opens downwardly and is secured to the rear panel along a bottom edge thereof except for a portion of the bottom edge left unsecured to define an opening for access to the inflation device.

5. The flotation device of claim 3 wherein the inflation assembly includes an inflation device in fluid communication with the bladder and an inflation cartridge which contains compressed inert gas, and operatively connects to the inflation device, the cartridge being actuatable to release the inert gas into the bladder for inflation thereof via pulling of a stretchable actuation cord, and further comprising:

a first end of the cord located in the pocket in securement with the cartridge, and a second handle end of the cord located outside of the pocket and retained within a cover spaced from the pocket, the cover secured to one of the side panels.

6. The flotation device of claim 5 and further comprising a channel extending between the pocket and the cover, the cord residing in the channel.

7. The flotation device of claim 1 and further comprising:

a stretchable neck panel secured to the bladder around the head opening.

8. The flotation device of claim 1 wherein each of the side panels is made of a lycra-nylon stretch fabric blend.

9. The flotation device of claim 1 wherein the bladder is made of two overlaid, edge secured pieces of lycra-coated polyurethane.

10. The flotation device of claim 1 wherein each of the head opening and the arm openings includes encircling elastic to tightly hold the flotation device to the torso.

11. The flotation device of claim 1 wherein the rear panel of the bladder includes two distinct sections separated by a seam.

12. The flotation device of claim 11 wherein the seam is vertical.

* * * * *